United States Patent [19]

Jones et al.

[11] Patent Number: 4,534,745

[45] Date of Patent: Aug. 13, 1985

[54] PERCUSSION CAP FIRING TOY VEHICLE AND TRACK ASSEMBLY

[75] Inventors: Lawrence T. Jones, Los Angeles; Robert S. Lee, Westlake Village; Walter Moe, Santa Monica; Ashley G. Howden, Los Angeles; Paul J. Ishikawa, Hermosa Beach, all of Calif.

[73] Assignee: California R&D Center, Culver City, Calif.

[21] Appl. No.: 576,867

[22] Filed: Feb. 3, 1984

[51] Int. Cl.[3] ..... A63H 5/00; A63H 29/00

[52] U.S. Cl. ..... 446/398; 446/429; 446/444; 238/10 A

[58] Field of Search ..... 446/398, 399, 400, 418, 446/429, 430, 431, 465, 470, 435, 444, 441; 273/86 B, 86 C; 238/10 R, 10 A, 10 E, 10 F

[56] References Cited

U.S. PATENT DOCUMENTS

| | | | |
|---|---|---|---|
| 1,617,480 | 2/1927 | Fourcher | 446/398 X |
| 1,621,140 | 3/1927 | Thompson et al. | 446/398 X |
| 2,531,056 | 11/1950 | Koesten | 446/430 X |
| 2,736,556 | 2/1956 | Dasher | 273/86 C |
| 3,000,137 | 9/1961 | Vine | 446/435 X |

*Primary Examiner*—Mickey Yu

*Attorney, Agent, or Firm*—Joseph W. Price

[57] ABSTRACT

A toy vehicle and track assembly is provided for the detonation of toy percussion caps. A striker member is pivotally mounted within a housing that is biased to rotate in a predetermined direction. The striker member is retained by a keeper member than can be selectively released. A door can be connected to the housing for positioning an anvil that is capable of mounting the toy cap within striking movement of the striker member for detonating the cap.

21 Claims, 8 Drawing Figures

FIG. 3
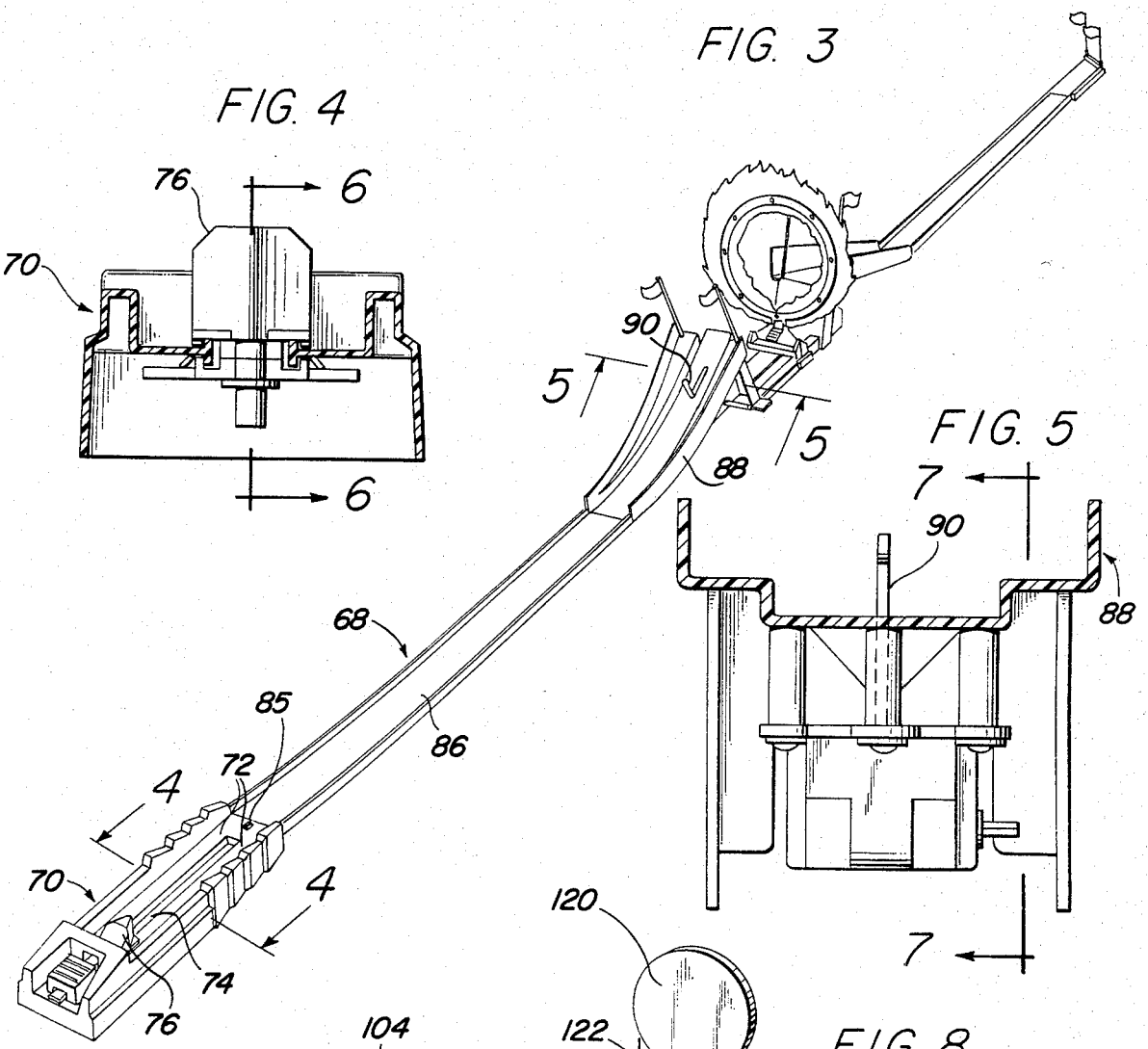
FIG. 4
FIG. 5
FIG. 8
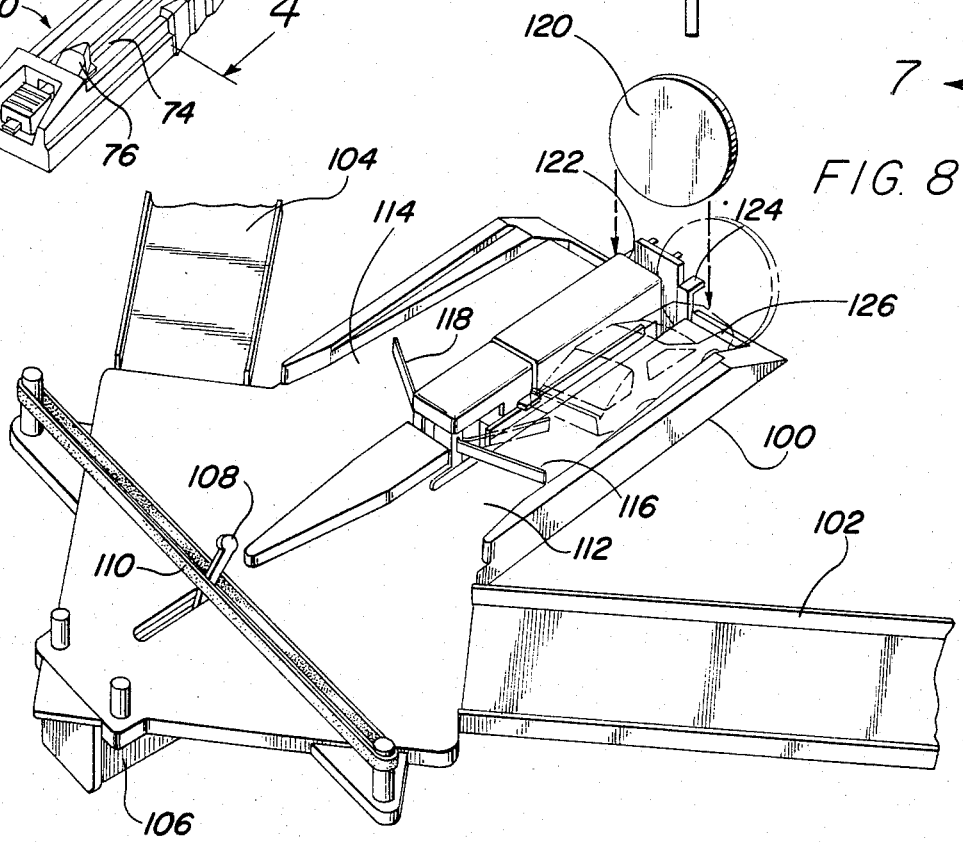

PERCUSSION CAP FIRING TOY VEHICLE AND TRACK ASSEMBLY

BACKGROUND OF THE INVENTION

1. Field of the Invention

The present invention is directed to a toy vehicle assembly, and more particularly to a toy vehicle that is capable of providing the detonation of toy percussion caps, either alone or in combination with a track set having auxiliary cap firing mechanisms mounted on or adjacent the track set.

2. Description of the Prior Art

The allure of exploding percussion caps to children is well known in the toy industry. Various types of toys have been provided to utilize this toy action feature apart from toy cap guns and pistols. For example, miniature rockets with removable cone front portions have been provided for receiving a percussion cap, and upon discharge of the rocket into the air, the cap will explode upon contact with a surface. An anvil or plunger is provided for either moving the cap or moving against the cap to provide a percussion detonation of the toy cap. There has also been suggested to provide a cap in a vehicle which would again rely upon an inertia conversion of forces to create a relative movement between a toy cap and an anvil member or striker member for exploding the cap at the immediate discharge of the toy vehicle or upon the toy vehicle hitting an object. Both of these types of toys utilize the inertia forces generated by the movement of the vehicle, either at its initialization of movement or at its conclusion, to ignite the toy cap. The creation of the Consumer Product Safety Commission has highlighted the necessity of providing relatively safe toys when dealing with percussion caps and has restricted the use of prior art toys of this nature.

Finally, the toy industry provides a leisure time product in a highly competitive field, and it is necessary to provide a relatively inexpensive construction while attempting to maximize the play action enjoyment of the child.

Accordingly, the prior art is still seeking to provide various types of novel toys that can safely utilize the proven attraction of percussion caps for children in economical vehicles and toy action sets.

SUMMARY OF THE INVENTION

The present invention is directed to a toy vehicle and a toy vehicle track set that is capable of igniting toy caps in a safe and economical fashion. The toy vehicle can comprise a housing body member of a subjective configuration that is mounted upon a chassis frame with appropriate wheels. Within the internal cavity of the housing body member, a spring-biased striker member can be pivotally mounted. A movably-mounted door is connected to the housing member and can carry an anvil for mounting a toy percussion cap wherein the toy cap can be conveniently positioned on the door and then brought into an operative position within the toy vehicle when the door is closed. A keeper member is also movably mounted within the housing member and provides a selective retention of the spring-biased striker member so that contact of the keeper member with an external object is capable of releasing the striker member for contacting the toy cap on the anvil. An appropriate actuator, for example, in the form of a simulated tire iron, can be utilized to pivot the striker member into an operative contact with the keeper member against the bias of the spring.

A track assembly including extruded plastic track of various subjective configurations is provided for controlling the direction of the vehicle or vehicles. A propulsion or launcher mechanism can be attached to the track to provide the initial driving force for the vehicle, and, for example, can comprise a resiliently biased launcher that can release spring energy that is stored for propelling the toy vehicle along the track system. The track system itself can incorporate track sections having various loops and inclines and also can incorporate ramps for propelling the toy vehicle into the air. Incorporated into the toy launcher, ramps and track system can be cap firing mechanisms that will fire auxiliary caps upon activation of an appropriate actuator position on the track with the toy vehicle as it moves along the track system. Additionally, the track can be provided with a protrusion for contacting the keeper member on the toy vehicle for appropriately exploding the cap at some position along the track.

Finally, a finish line base member can be connected to the termination of one or more track sets for providing an explosive indication of the completion of the translation of the toy vehicle along the track system. The finish line base member can incorporate a cap firing mechanism and can also incorporate a visual indicator in the form of a stopper disc member that is released upon completion of the transit of the toy vehicle. Advantageously, the finish line base member can be connected to a dual track system to permit respective toy vehicles to compete in a race, and the disc member can be released to maintain the winning vehicle on the finish line base member.

The object and features of the present invention are set forth in the appended claims. The present invention may be best understood by reference to the following description taken in conjunction with the accompanying drawings in which like numerals indicate like parts.

BRIEF DESCRIPTION OF THE DRAWINGS

FIG. 3 is a perspective view of one form of the toy vehicle assembly of the present invention;

FIG. 4 is a cross-sectional view of a toy launcher;

FIG. 5 is a cross-sectional view of a toy ramp;

FIG. 8 is a perspective view of a finish line base member that can be attached to one or more toy vehicle track sets.

DESCRIPTION OF THE PREFERRED EMBODIMENTS

The following specification, taken in conjunction with the drawings, sets forth the preferred embodiments of the present invention in such a manner that any person skilled in the toy industry can practice the invention. The embodiments of the invention disclosed herein are the best modes contemplated by the inventors for carrying out their invention in a commercial environment, although it should be understood that various modifications can be accomplished within the parameters of the present invention.

Figure 1:
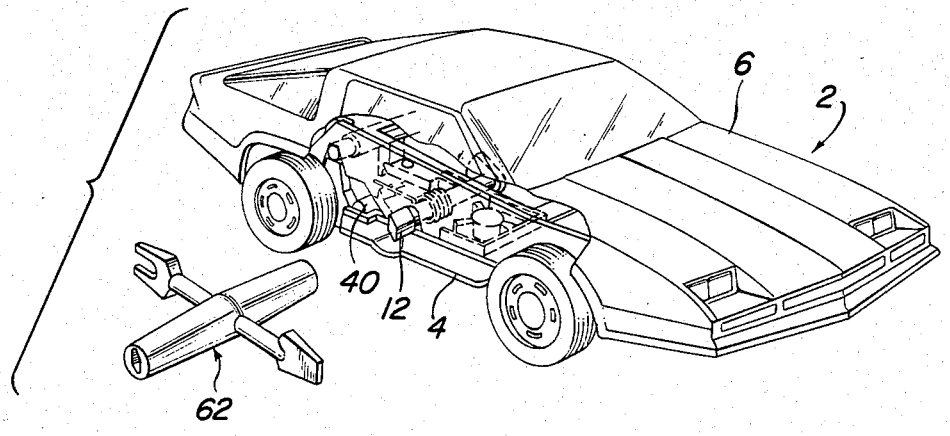
FIG. 1 is a perspective view with a partial cutaway of the toy vehicle of the present invention.

Referring now to the drawings, and more particularly to the partial cross-sectional perspective view of FIG. 1, a toy vehicle 2 of the present invention is disclosed. A chassis frame 4 mounts a subjectively configured auto body or housing member 6. Mounted within the housing member is a striker member 8 of an elongated rod configuration having a stopper portion 10 at one end and an actuator stem 12 at the other end. At a central location on the rod, a hammer lever 14 extends traversely away from the longitudinal axis of the striker rod. A spring 16 can be twisted about the striker member and anchored on the hammer lever 14 at one end and on the chassis frame at the other end. The spring 16 also serves a locking function to be described.

Figure 2:
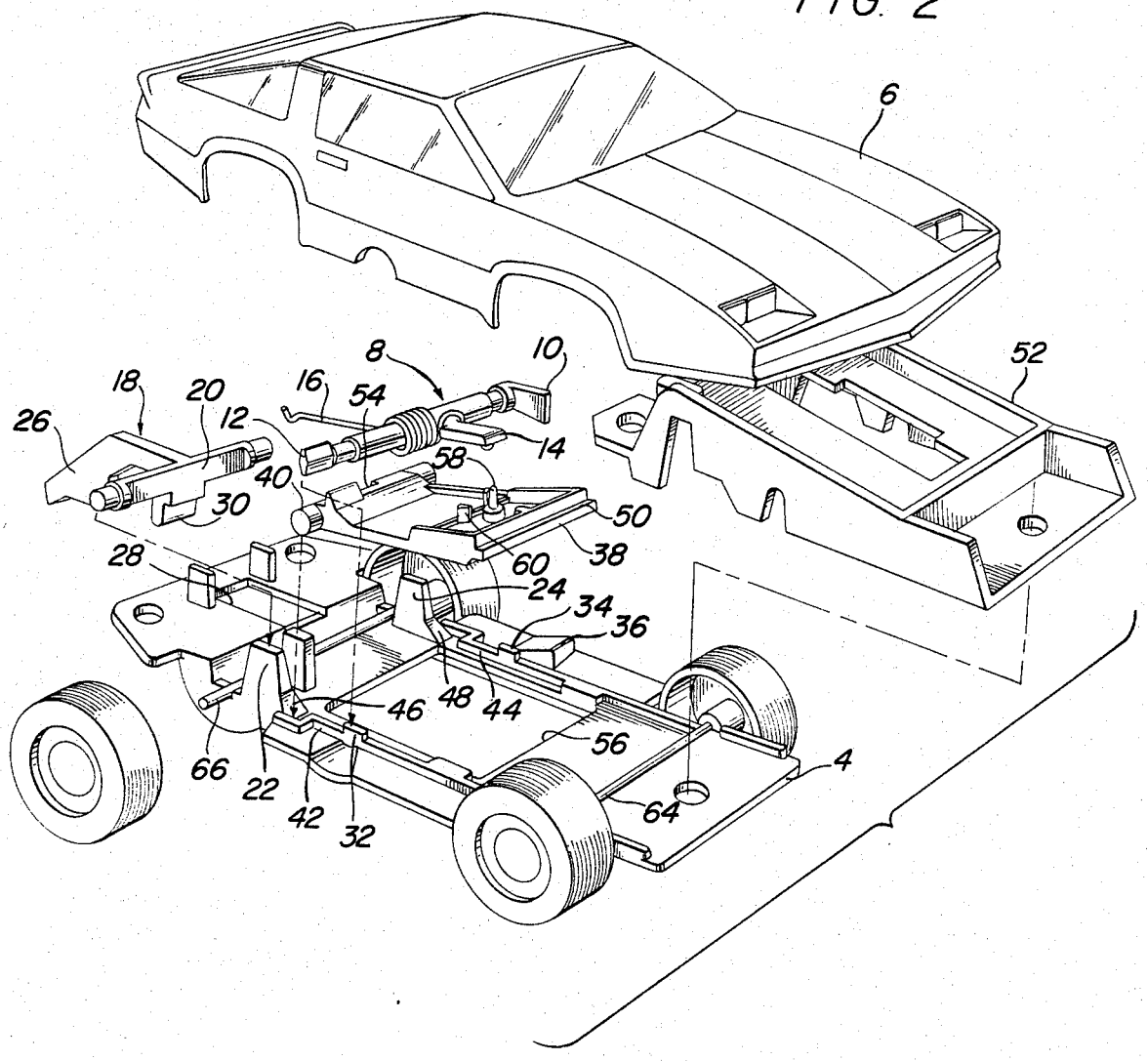
FIG. 2 is a perspective exploded view of the toy vehicle of the present invention.

As seen in FIG. 2, the keeper member 18 has a rod-like configuration 20 with circular ends that are adaptable for rotational mounting upon mounting posts 22 and 24 that extend upward from the chassis frame 4. Midway along the rod portion 20 is a keeper trigger member 26 that is designed to extend downward through an opening 28 in the chassis frame 4. At a right angle to the connection of the trigger member 26 with the rod-like portion 20 of the keeper member 18 is a retainer flange 30 having a complementary configuration for holding the head of the hammer lever 14 against the bias of the spring 16. The trigger member 26 is designed so that its weight will rotate the retaining flange 30 into an operative contact with the hammer lever 14 when it is rotated counterclockwise relative to the side of the actuator stem 12. A corresponding clockwise movement of the member 26 will release the striker member 8. The striker member 8 rests on bearing posts 32 and 34. The stopper portion 10 is designed to contact the stopper member 36 mounted on a chassis frame 4 and prevent any further rotation, so that the hammer lever 14 always is maintained within the cavity of the vehicle body.

The door 38 has a bearing axle 40 at one end that is designed to be positioned within a pair of retaining ledges 42 and 44 rising from the surface of the chassis frame 4. A pair of camming surfaces 46 and 48 on the respective mounting posts 22 and 24 permit the ends of the bearing axle 40 to move backward and upward as they pivot, providing a push-pull latching mechanism for retention of the door member 38. A support ledge 50 at the other end of the door member 38 can rest against the interior surface of the chassis frame for holding the door in position. Finally, the position of the spring 16 is such that it extends across the rear of the bearing axle 40 when held in position on the chassis frame 4 by the retaining frame 52. The spring force is increased when the hammer lever 14 is rotated into stationary contact with the keeper member 18 and forces the door member 38 downward into a locked position.

When the hammer lever 14 of the striker member 8 is extended forward, the spring 16 has minimal pressure, and it is relatively easy to both push and rotate the door member 38 backwards against the camming surfaces 46 and 48 to open egress to the interior of the toy vehicle 2 through the aperture 56. The door member 38 has its support ledge 50 released from the chassis frame 4 and can swing downward to permit access to the anvil 58 on the door member 38. A cylindrical cap member (shown in dotted lines in FIG. 1) can be positioned on the anvil 58 and frictionally retained by a series of equally spaced friction posts 60 mounted on the door member 38 about the anvil member 58.

After the cap is appropriately mounted on the anvil member 58, the door 38 can be pushed backward and upward for closing it flush with the chassis frame 4. The door 38 is inserted into a locked position by a forward horizontal movement to engage the support ledge 50 with the front portion of the aperture 56.

An actuator key 62 that can be configured to simulate a tire iron can be used to engage the actuator stem 12 of the striker member 8. Rotation of approximately 180° of the actuator key 62 in a counterclockwise direction will engage the hammer lever 14 of the striker member 8 with the retaining flange 30 on the keeper member 18. During this rotation the spring member 16 stores spring energy and its tail portion presses against the door 38 to limit its ability for rearward motion upward against the camming surfaces 46 and 48. In effect the spring member 16 serves a dual function of bracing the hammer lever 14 and locking the door 38 in place to prohibit opening of the door member 38 with the striker member 8 in a spring-biased position. As an additional safety feature the stopper portion 10 is designed to coact with the stopper member 36 to prohibit a clockwise rotation of the striker member 8 so that it could extend through and beyond the aperture 56 for contact with the child's hand.

As can be readily appreciated, numerous safety features are provided by the design with relatively few parts. The percussion cap is only detonated when the door member 38 is closed to encapsulate the cap within the cavity of the toy vehicle. The door member 38 is locked when the striker member is placed into a spring-biased operative position. Finally, the striker member itself is prohibited from extending beyond the horizontal plane of the chassis frame 4 by virtue of the stopper mechanism 10 provided at one end of the striker member 8.

The chassis frame 4 also carries the axles 64 and 66 of the front and rear wheel assemblies, and these axles are held in position by a retaining frame 52 as it is mounted above the retaining ledges 42 and 44 on the chassis frame 4. As can be seen from FIG. 2, the retaining frame 52 also positions the keeper member 18, striker member 8 and door member 38. The chassis frame 4 also combines an appropriate aperture for receiving fasteners for retention of the toy vehicle, and also has spacing posts to ensure the proper positioning of the toy vehicle body 6 relative to the chassis frame 4.

Figure 6:
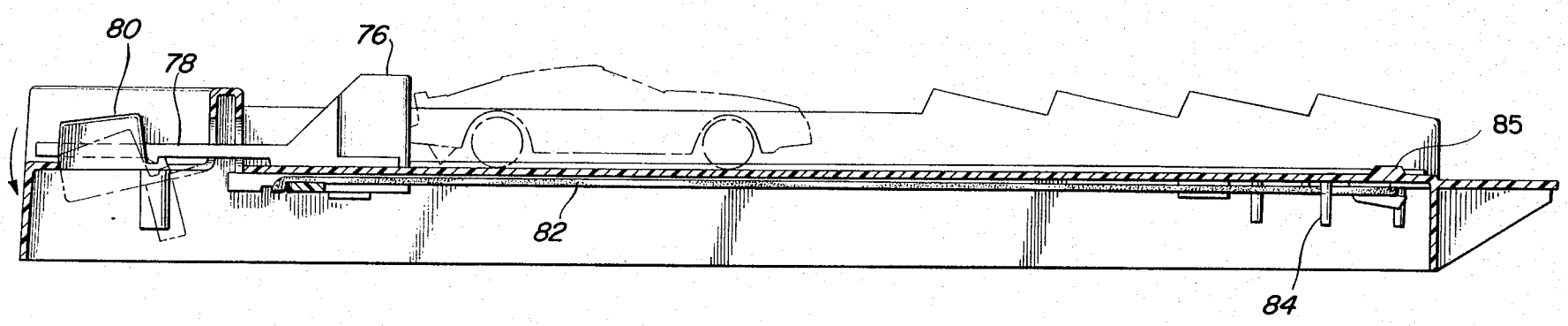
FIG. 6 is a cross-sectional view of a toy launcher taken along the axial direction of the toy launcher.
Figure 7:
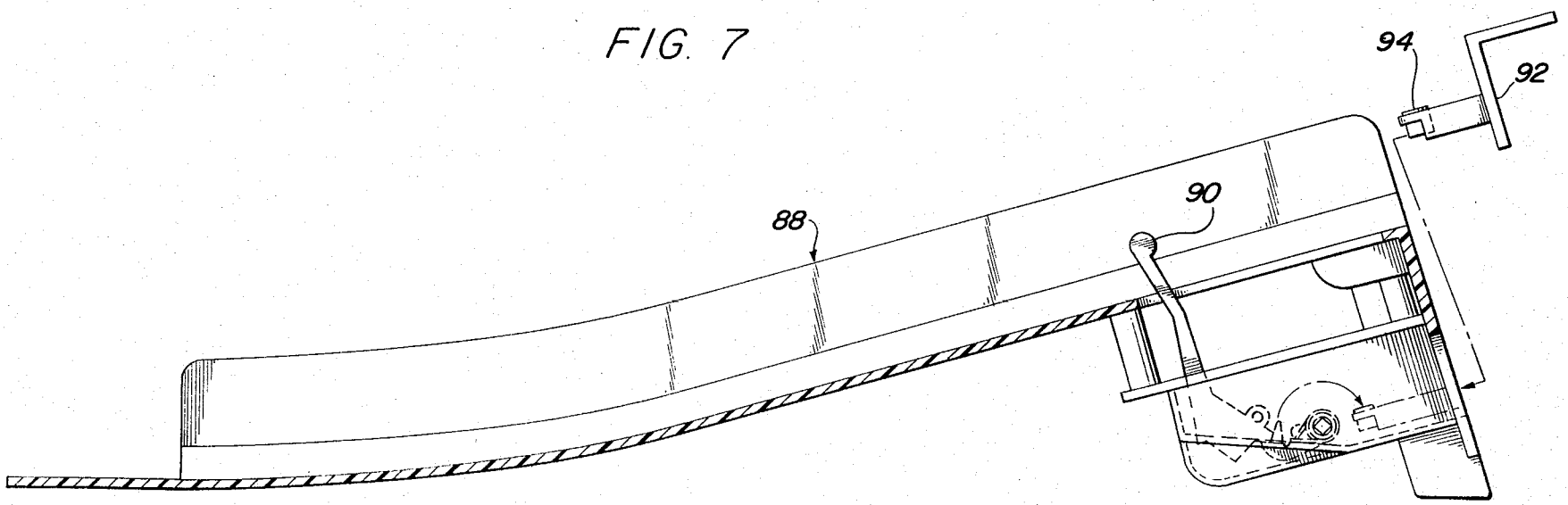
FIG. 7 is a cross-sectional view of a toy track ramp taken along the longitudinal axis of the ramp.

Referring to FIG. 3, a toy vehicle set 68 is disclosed for both propelling and directing the toy vehicle 2 of the present invention. At one end of the toy vehicle set 68 is a launcher assembly 70 that can be seen in further detail in FIGS. 4 and 6.

Basically the launcher assembly 70 provides a pair of rails 72 having a central aperture 74. A sliding actuator 76 is journalled in the central aperture 74 and includes an integral serrated tail portion 78. The serrated tail portion 78 can extend through a cantilevered trigger member 80 that can be integrally molded in plastic to provide sufficient vertical flex for release of the sliding actuator tail portion 78. One or more rubber bands 82 can be extended between mounted posts 84 and retention slots in the sliding actuator 76. The particular mounted post 84 selected will determine the amount of stretch of the rubber band, and accordingly the kinetic force that can be generated. The protrusion 85 can activate the keeper 26 for firing the cap.

Sections of individual tracks 86 can be subjectively joined and configured to provide a race track or path for the toy vehicle 2. A jumping ramp 88 can be provided with a cap firing mechanism also having a spring-biased striker member designed to coact with the keeper member 90. Again, an actuator key (not shown) can be utilized for rotating the spring-biased striker member within the ramp member 88 to arm the cap firing mechanism. A sliding door 92 can carry a cap 94 for insertion into operative range of the striker member.

As can be appreciated, the passage of the toy car will contact the keeper member 90 and release the striker member for activation of the percussion cap 94.

Referring to FIG. 8, a finish line assembly 100 is disclosed in a perspective view. The finish line assembly is capable of receiving respective connections to track sections 102 and 104 to permit two toy vehicles to engage in a race along preferably identical lengths of track sections setting forth identical courses. The purpose of the finish line assembly 100 is to indicate the winner of the race with an appropriate detonation of a percussion cap along with a visual indication of the winner being retained on the finish line assembly 100.

A cap firing mechanism 106, similar in construction to the cap firing mechanism incorporated in the ramp member 88, is provided with a keeper member 108 extending above the track surface and encompassed by an elongated rubber band 110. The position of the rubber band 110 or other resilient members relative to the respective track sections 102 and 104 is such to permit a deflection of the rubber band through the operative range of the keeper member 108 for detonation of a cap (not shown) in the cap firing mechanism 106. The toy vehicle is then ejected by the rubber band 110 in a direction approximately perpendicular to the disposition of the rubber band 110 as shown in FIG. 8. The vehicles travel the track portion 112 or 114, depending upon their respective course, and the first vehicle to engage a gate member 116 or 118 will release a disc 120 from its containment between the stoppers 122 and 124. Disc 120 can then travel to the right or left, depending upon the activation of the appropriate stopper member along a traversing channel 126 that extends on either side of the disc member. The disc member 120, when released, provides a barrier to the further travel of the toy car member which forces the car member to be stopped and held on the appropriate track section, indicating the winner. The respective gate members have their bases journalled in a rod connected to the respective stop members. Rotation of the gate member immediately releases the appropriate stop member for a gravitational movement of the disc member 120 into the groove 126. The winning car then contacts the disc member 120 and is retained on the finish line assembly 100. The losing car also activates its respective gate member, but the disc member 120 has already been released on the winning car's side, and accordingly the losing car egresses off of the end of the finish line assembly 100.

As can be readily appreciated, the component parts of the toy vehicle 2, the track sections, the launcher assembly 70, the finish line assembly 100, the ramp sections 88 and other accessory and component parts provided to simulate a racing toy car set can be advantagously molded from plastic. Also, subjective indicia can be provided for these component parts to discriminate different species of the present invention. Accordingly, manifestations of the above-described embodiments of the present invention may become readily apparent to those skilled in the art in light of the above-disclosed generic concepts. Therefore, the scope of the present invention should be interpreted solely from the followng claims.

What is claimed is:

1. A toy vehicle capable of igniting a toy cap comprising:

a housing body member;

means for transporting the body member across a support surface;

a striker member pivotally mounted within the housing member;

means for biasing the striker member to rotate in a predetermined direction;

a keeper member movably mounted in the housing member for selective retention of the biased striker member in a biased position, a portion of the keeper member extending beyond the housing body member in a position to permit actuation for releasing the striker member; and a movably mounted door connected to the housing member and carrying an anvil for mounting a toy percussion detonatable cap, the position of the anvil within the housing member with the door in a closed position being within the operative striking movement of the striker member.

2. The invention of claim 1 further including a chassis member mounted to the housing body member and a retaining frame member connected to the chassis member for retaining the striker member, keeper member and door.

3. The invention of claim 1 wherein the door member is mounted for both a pivotal and translational movement relative to the housing body member.

4. The invention of claim 1 wherein the keeper member has a retention ledge and the striker member has a complementary retention ledge for holding the striker member in a biased position.

5. The invention of claim 1 further including an actuator key, the striker member having a transverse stem that is removably connectable by the actuator member for moving said striker member into operative contact with the keeper key.

6. The invention of claim 2 further including a front and rear wheel assembly, the retaining frame member holding the respective front and rear wheel assemblies in an operative position.

7. The invention of claim 3 wherein the door member further includes three post members adjacent the anvil for the frictional retention of a cap.

8. The invention of claim 3 wherein the door member contacts a pair of substantially vertical camming members to provide an upward movement to the door member relative to the housing body member.

9. The invention of claim 3 wherein the means for biasing includes a spring member that contacts both the striker member and the door member whereby the door member is locked when the striking member is placed in a biased position.

10. The invention of claim 5 wherein the actuator key has a simulated tire iron configuration.

11. A toy vehicle play set capable of igniting caps comprising:

a toy vehicle having a housing body member;

a spring-biased striker member pivotally mounted within the housing member;

a keeper member movably mounted in the housing member for selective retention of the spring-biased striker member in a spring-biased position, a portion of the keeper member extending beyond the housing body member in a position to permit actuation for releasing the striker member;

a movably mounted door connected to the housing member and carrying an anvil for mounting a percussion detonatable cap, the position of the anvil within the housing member with the door in a closed position being within the operative striking movement of the striker member;

a track assembly for guiding the toy car;

means on the track assembly for activating the keeper member to release the striker member; and means for propelling the toy car along the track assembly.

12. The invention of claim 11 further including a cap firing mechanism mounted on the track assembly including an actuator keeper member positioned relative to the track assembly for activation contact with the toy vehicle.

13. The invention of claim 12 wherein the cap firing mechanism is mounted within a ramp so that the toy vehicle detonates a cap as it travels up the ramp and is then propelled into the air.

14. The invention of claim 12 wherein the cap firing mechanism includes a housing member; a spring-biased striker member pivotally mounted within the housing member; said actuator keeper member movably mounted in the housing member for selective retention of the spring-biased striker member in a spring-biased position, a portion of the keeper member extending beyond the housing body member in a position to permit actuation for releasing the striker member and movably mounted door connected to the housing member and carrying an anvil for mounting percussion detonatable cap, the position of the anvil within the housing member with the door in a closed position being within the operative striking movement of the striker member.

15. The invention of claim 14 wherein the cap firing mechanism further includes a complementary track section and an indicator member for visually disclosing the passage of the vehicle.

16. The invention of claim 11 wherein means for propelling the toy car includes a rubber band biased launcher.

17. The invention of claim 11 further includes a finish line assembly attached to the track set, the finish line assembly having a cap firing mechanism for activating a cap.

18. The invention of claim 17 wherein the finish line assembly includes a resilient barrier for redirecting the toy vehicle after contact.

19. The invention of claim 18 wherein the finish line assembly includes a stop member positioned for gravitational movement to block egress of the toy vehicle off of the finish line assembly and means for releasing the stop member in response to movement of the toy vehicle.

20. The invention of claim 19 wherein the stop member is a rotatable disc.

21. In a toy vehicle track set capable of directing toy vehicles, the improvement including an accessory item coacting with the toy vehicle comprising:

a housing member;

a spring-biased striker member pivotally mounted within the housing member;

means for positioning a percussion detonatable cap within operative range of the striker member in the housing member; and a keeper member movably mounted in the housing member for selective retention of the spring-biased striker member in a spring-biased position, a portion of the keeper member extending beyond the housing member in a position to permit actuation upon contact with a toy vehicle.

* * * * *